United States Patent [19]

Grundell

[11] 3,971,502

[45] July 27, 1976

[54] BOX-SHAPED PRODUCT

[76] Inventor: Carl-Erik Grundell, 8 Osmogatan, 122 48 Enskede, Sweden

[22] Filed: Sept. 25, 1974

[21] Appl. No.: 509,038

[30] Foreign Application Priority Data

Sept. 27, 1973 Sweden ..... 7313202
Mar. 20, 1974 Sweden ..... 7403746

[52] U.S. Cl. ..... 229/14 R; 40/359; 312/184

[51] Int. Cl.[2] ..... B65D 5/62

[58] Field of Search ..... 229/19, 9, 14 BE, 14 R; 312/184; 40/359

[56] References Cited

UNITED STATES PATENTS

| | | | |
|---|---|---|---|
| 1,738,120 | 12/1929 | Schaffert | 40/359 |
| 1,798,321 | 3/1931 | Evans | 40/359 |
| 2,274,344 | 2/1942 | Palmer | 229/14 BE X |
| 3,298,374 | 1/1967 | Grundell | 312/184 |
| 3,495,756 | 2/1970 | Achermann et al. | 229/14 R |
| 3,779,393 | 12/1973 | Grundell | 40/359 |

*Primary Examiner*—Stephen P. Garbe
*Attorney, Agent, or Firm*—Ulle C. Linton

[57] ABSTRACT

A box having an inner box-shaped member of a relatively rigid but foldable material and having at least one side open and a cover member of a relatively thin, but foldable material which extends over at least the bottom and two opposite sides of said box-shaped member as well as the upper portions of said box-shaped member sides with a profile on said side upper portions.

7 Claims, 10 Drawing Figures

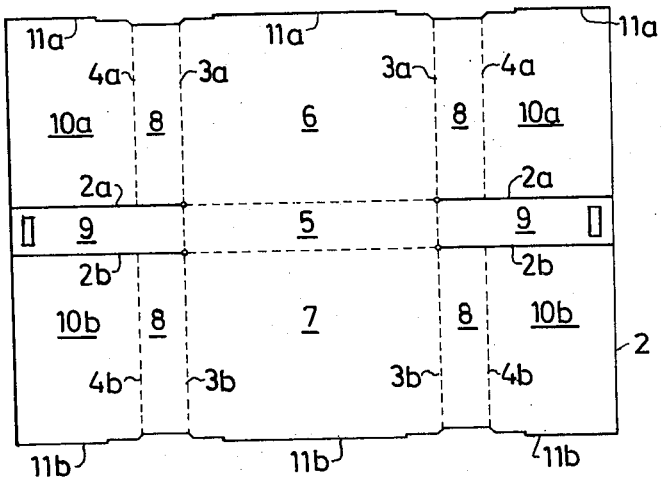
Fig. 1
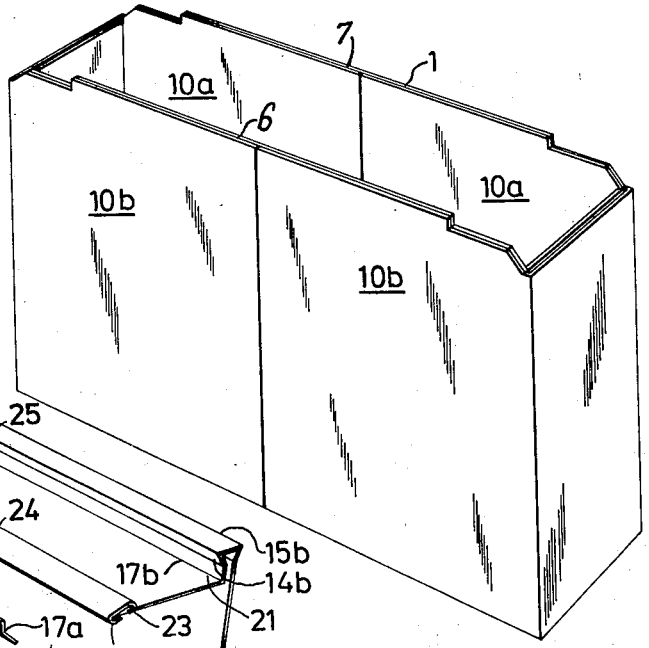
Fig. 2
Fig. 3
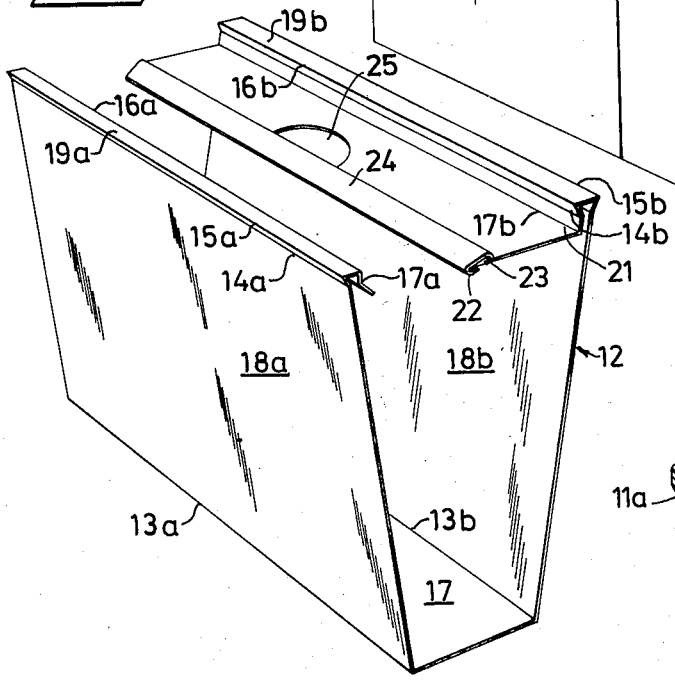
Fig. 4
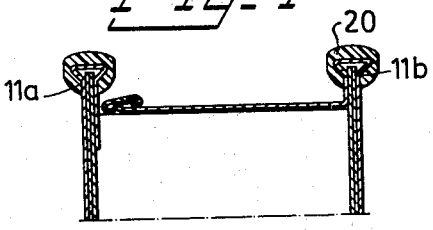

BOX-SHAPED PRODUCT

This invention relates to a storage box or a similar box-shaped product from a sheet material such as cardboard and also relates to a method for producing the same.

It is previously known to design a carton or a cardboard box in such a manner that it may be changed from a substantially planar storage and transportation position to an operating position, whereupon the sides may be secured to each other such as by inserting punched flaps of one box side into corresponding slots in another side. The products thus obtained usually have poor stability and have an unesthetical appearance due to the visible securing means.

An object of the invention is thus to obtain a product that may be assembled by means of some simple movements of the hand to a stable and esthetically attractive box. Another object is to minimize the production cost by using a relatively inexpensive material for the inner and substantially invisible parts of the box. A further object is to provide a lid and a snap device to lock said lid in its closed position.

To accomplish these and other objects the invention is characterized as disclosed in the claims.

In the accompanying drawing an examplifying embodiment of the invention is shown.

FIG. 1 shows a blank for producing the inner member of the box,

FIG. 2 shows said inner member in an assembled condition and

FIG. 3 is a perspective view of the outer member of the box

FIG. 4 is a section through the upper portion of the complete box including the lid

Figure 6:
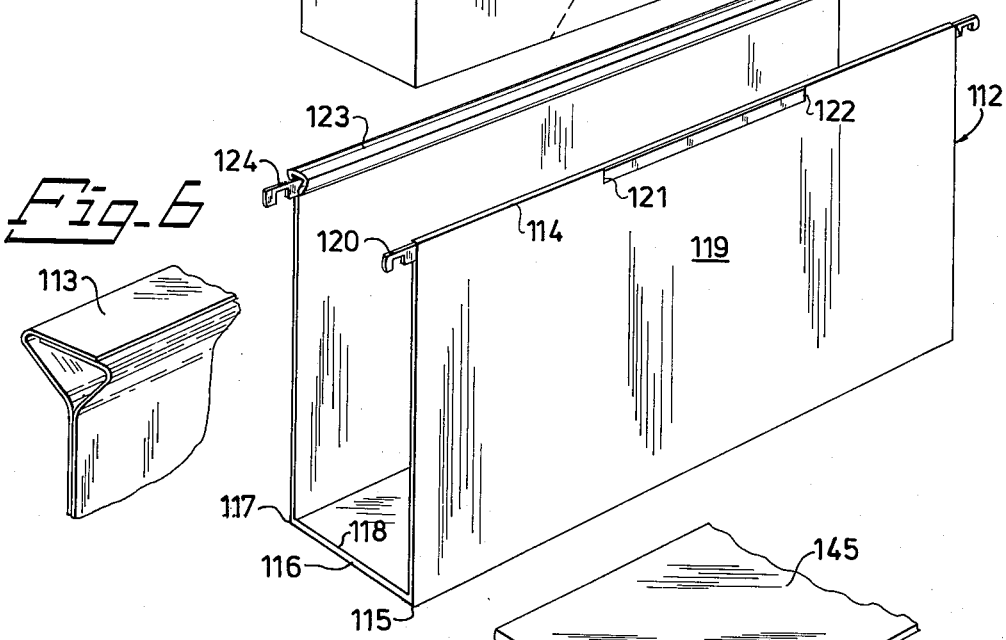
FIG. 6 is a perspective view of the outer member for said modified box.

FIG. 6*a* is an enlarged perspective detail view of a portion of the free edges of the outer member of FIG. 6.

Figure 7:
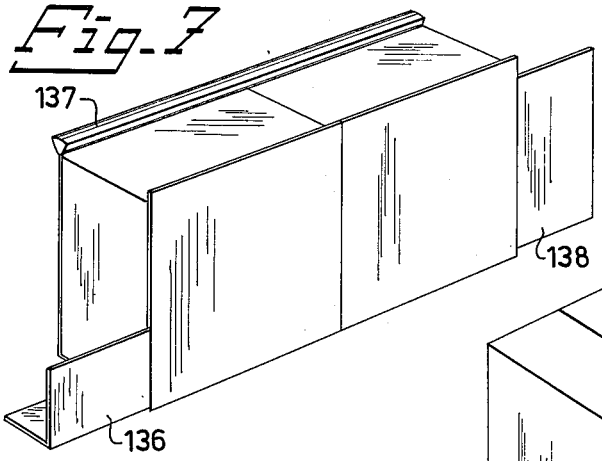
Figure 8:
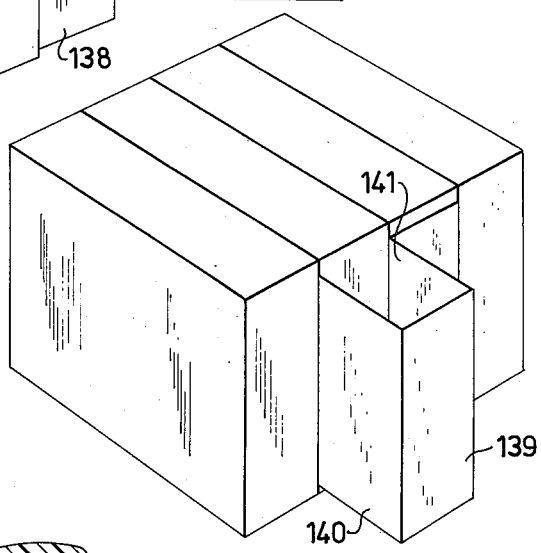

FIGS. 7 and 8 illustrate different ways of connecting the boxes

Figure 9:
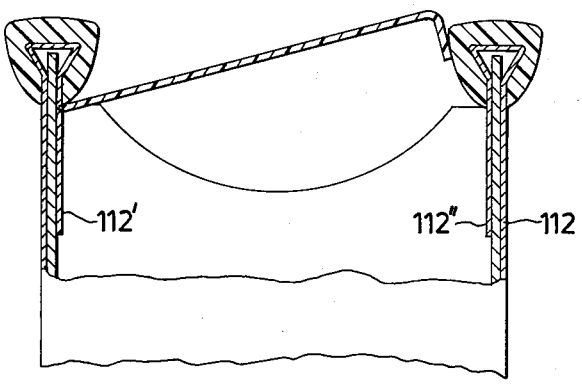
Figure 9:
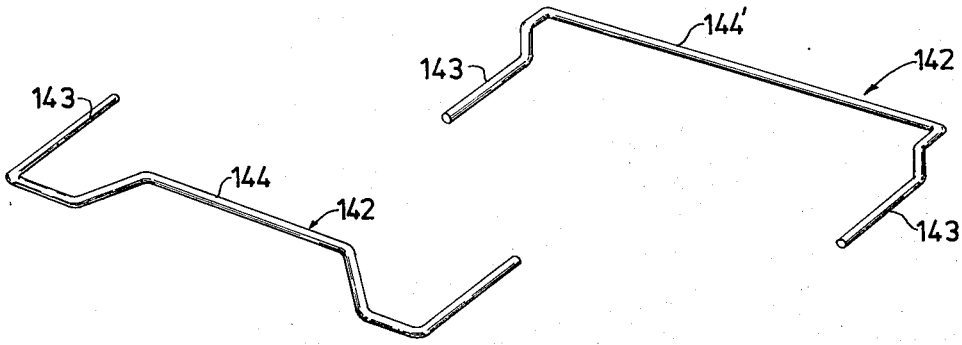

FIG. 9 is a section through a further modification of the invention, and

FIG. 9*a* is a perspective view of a bracket,

FIG. 9*b* is a perspective view of a modified form of bracket.

Figure 10:
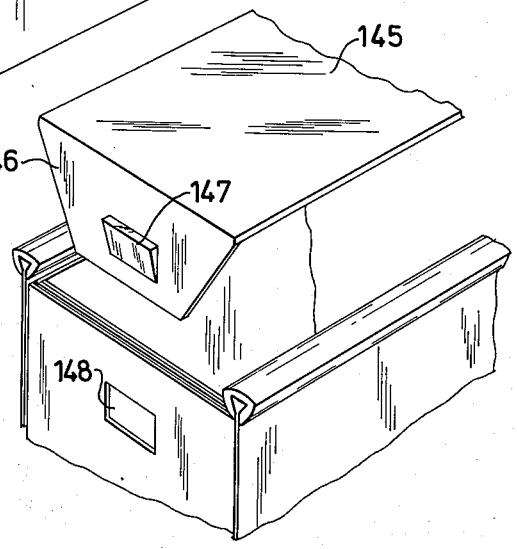

FIG. 10 is a perspective view of a part of a box with a lid.

The box-shaped product according to FIGS. 1–4 comprises an inner member generally designated 1. Said inner member is produced by folding a planar material or blank of rigid paper, cardboard or the like. In the illustrated embodiment a substantially rectangular blank or material 2 is used. Said blank has punched lines 2*a*, 2*b*, and folding lines 3*a*, 3*b*, 4*a*, 4*b* and may thus be assembled into the condition shown in FIG. 2. The surface 5 defines the bottom of the box 1, the surfaces 6 and 7 define the front and rear sides of the box, respectively, and the surfaces 8 define the short sides of the box. The surfaces 9 and 10*a*, 10*b* define reinforcements for the short sides and front and rear sides, respectively. As may be seen in FIG. 1 in such a design the loss of the material is minimized and all the sides of the inner box, besides from the bottom will have double material thickness. As further appears from FIG. 1, the sides of the blank which are intended to define the top edge portion of the inner box are extended upwardly 11*a* and 11*b*, respectively, for a purpose to be described. It is to be understood that the inner portion now described may be assembled to substantially the position shown in FIG. 2 by some simple manual movements. In practice the front portions 10*b* diverge somewhat since they are not held together.

Further, the improved box-shaped product comprises an outer member generally designated 12. Said member may be made from a material which is thinner than that of the inner member and preferably consists of polished paper or cardboard but also a plastic material or the like may be used. Similarly to the inner member the outer member is made from a planar blank which by folding along folding lines 13*a*, 13*b*, 14*a*, 14*b*, 15*a*, 15*b*, 16*a*, 16*b* may be formed to a cover having a back portion 17 that substantially corresponds to the bottom 5 of the inner box, two side portions 18*a*, 18*b* essentially corresponding to the sides 6, 10*a*, 7 and 10*b*, respectively, of the inner box and substantially T-shaped securing elements 19*a*, 19*b*. As may be seen in FIG. 4, the outer member has such a dimension that it may surround said portions of the inner box, whereby the upright edge portions 11*a*, 11*b* of said inner members are positioned within the T-shaped securing elements and preferably engages the inner side of the upper substantially horizontal part of each securing element, respectively.

By erecting said inner member and mounting the outer member according to the description above and thereafter sideways pushing a profile 20 provided with a corresponding longitudinal T-shaped groove over each edge portion 19*a*, 11*a* and 19*b*, 11*b*, respectively, an effective locking of the members of the box is obtained as well as a substantial reinforcement of the box opening. By the use of profiled longer than each side 6, 10*a*, 7 and 10*b*, respectively and by providing the projecting portions of the profiles with end plugs the box may be suspended according to the principle for a suspension document file and by making the profiles transparent all sorts of information, such as concerning the content of the box, may be read by means of tapes inserted into the rails. In several cases it may also be desired to close the opening of the box and for this purpose in the embodiment shown the blank does not terminate a short distance below the folding line 17*b*, which is the case when a lid is not desired, but continues for a distance approximately corresponding to the width of the surface 5. At a relatively short distance from the folding line 17*b* a first folding line 21 is provided parallel thereto. Said folding line will define the pivot axis of the lid. By folding the blank along a second 22 and a third 23 folding line and by sideways inserting the edge folded portion into a C-shaped profile 24 the free edge of the lid will have a rigid rail. The rail or the profile is obliquely positioned according to the drawing but owing to the elasticity of the sheet material and the folding line 21 the profile may be turned in relation to the rest of the lid and the profile 24 by the closing of the lid will thus snap behind the wider portion of the profile 20 and thereby secure the lid in its closed position. To facilitate the opening step the lid may be provided with an opening 25 through which a finger may be inserted.

From the above description it may be seen that the box according to the invention may be produced at a low cost and in a design permitting the storage thereof in a planar and space saving condition and the box may be assembled very rapidly. Furthermore, by means of the relatively rigid material of the inner box and by means of the profiles reinforcing the box opening and securing the rest of the box members together a very tough and useful box is obtained, that may be given every desired surface finish by selection of the outer member. While the short sides of the box in the embodiment shown are not covered by the outer member this latter may of course be designed so that it also covers these sides. The illustrated embodiment relates to a relatively high and narrow box, but, of course, the invention is not limited to any certain ratios of height, length and depth but may as well be applied to make boxes for card registers and the like. One single outer member may by use of additional folding lines be used in connection with inner members having other ratios concerning height and depth.

Owing to its stability the box according to the invention may be used in an upright, reclined or suspended position and therefore, is also suited for a great number of applications. By reinforcing the short sides of the box a number of boxes with contents may be placed upon each other and, despite of this, the lid for each one of these boxes may be opened by the snap action substantially depending upon the elasticity of the lid adjacent the edge zone thereof. It is also possible to provide a locking action between lid and box by sideways inserting a detail, for example, made from a bent thread, and gripping into the profile rails of the box. Such a detail designed for the embodiment shown in FIG. 9 is shown in FIGS. 9a and 9b. Among other possibilities to vary the invention may be mentioned the replacement of the rail provided with a T-shaped groove with a rail having a T-shaped groove in two opposite surfaces whereby two boxes may be connected to each other.

Figure 5:
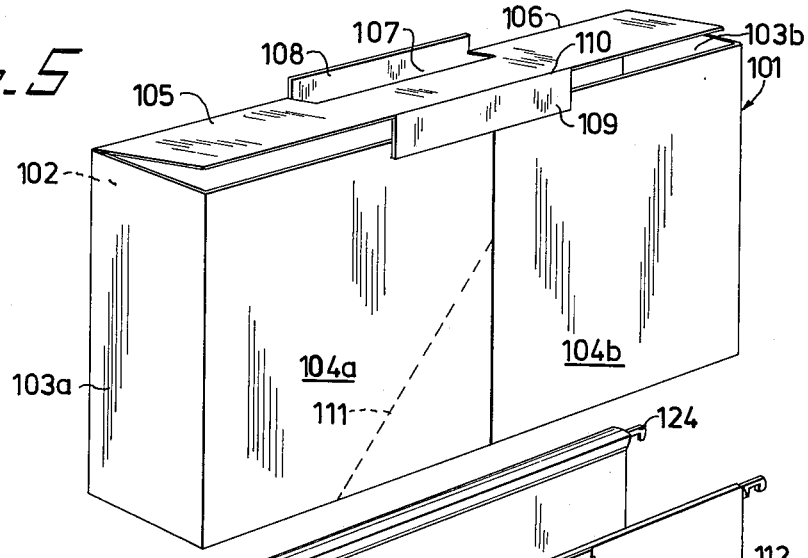
FIG. 5 is a perspective view of the inner portion of a somewhat modified box.

In the embodiment according to FIG. 5–6 the member 101 lacks a bottom and thus, comprises a rear portion 102, gables 103*a*, 103*b* connected thereto and a front portion comprising parts 104*a*, 104*b* integral with the gables. A part 105 projects from the rear portion defining the lid of the box by means of a folding line 106. By means of a punching 107 an upwardly directed part 108 is defined adjacent the folding line and intended to engage the rail provided with a T-shaped groove. The part 105 to define the lid of the box may suitably have an insertion flap 109 that extends substantially perpendicular to the actual lid by means of a folding line 110. The cover 112 in the embodiment shown in FIG. 6, is of the same type as described above, i.e. it comprises a double folded sheet the free ends of which are bent in order to define a substantially T-shaped connecting portion 113 according to the enlargement shown in FIG. 6*a* to the left in FIG. 6. The cover may be formed to the shown shape by means of folding lines 114, 115, 116, 117 whereby folds 116, which may of course be replaced by one or more folding lines, permit production of bottom portions of different widths. To obtain a steady bottom despite of the rigid inner member lacking a bottom a bottom plate 118 is sideways inserted between the two layers of the cover.

The loose bottom 118 may be longer than the cover and these projecting ends thereby for example permit the guiding of the boxes in a connected condition to be suspended to a wall etc.

The interior of the box may be divided into two or several compartments by means of bent cardboard insertions.

According to a method for lengthwise connection of boxes an L-shaped profile 136 is as shown in FIG. 7 inserted into the boxes between their cover and inner member. Furthermore, according to this FIGURE a rail 137 is used having a length equal to two or several boxes and a simple connection between several boxes may be made in a simple manner. An extended bottom 118 or boards 138 inserted between the cover and the inner member thereof and extending over the length of several boxes is another possible connection. All these elements may be used both separately and in combination and further, they define a reinforcement of the boxes.

Consequently, by means of very simple means it is possible to accomplish products wanted for various purposes. To connect boxes according to FIG. 8 U-shaped plates 139 may for example be used which may have a long leg 140 and a shorter leg 141 to facilitate the insertion between the cover and the inner member.

The embodiment shown in FIG. 9 differs from the embodiment according to FIG. 5–6 substantially in that the outer member 112 does not fully surround the inner member, whereby the ends of the outer member are designated by 112′, 112″, respectively. In order to effectively close the box such as for transportation purposes and the like, brackets 142 having legs 143 may be used with said legs being inserted into the ends of the profiles. Since the center portion 144 of the bracket is located right above the lid this one may not be opened before said brackets are removed.

The bracket 142 may also serve as a suspension means in case the web portion is bent out of the plane 144′ and projects outside the box rather than being positioned inside this.

In the embodiments in which the inner member has double or treble short sides according to FIG. 10 it is possible to use for closing the box a lid 145 having thin walled legs 146 provided with projections 147, said legs being inserted between the short side layers of the inner member. By the provision of a punched hole 148 in at least one of these layers into which hole the actual projection is to snap, a very effective closure of the box is obtained. This closure may also be made sealable in a postal sense. A transparent lid may thereby also be provided with titles, head lines, etc.

I claim:

1. A box, comprising an inner box-shaped member made from a relatively rigid but foldable material and having a bottom, two opposite sides and at least one open side, and a cover member made from a relatively thin but foldable material which extends over at least said bottom and said two opposite sides of said box-shaped member, characterized in that said cover has portions, each folded over one of said opposite sides of said box shaped member, and slotted members each surrounding one of said folded portions and securing said folded portions to said box-shaped member sides at least against displacement in a direction perpendicular to said box-shaped member sides.

2. A box according to claim 1, characterized in that at least one of said cover portions forms a bead having a wide upper portion and a narrow lower portion and said slotted member has a correspondingly shaped longitudinal groove slideably mounted on said bead.

3. A box according to claim 2, characterized in that the portion of the cover which defines one of said beads is extended to provide a lid bridging said open side of said box shaped member and a folding line defining the pivotal axis of said lid is provided at a predetermined distance from said slotted member.

4. A box according to claim 2, characterized in that said lid has a free edge, a rail is secured to said lid free edge and one of said slotted members has an upper wider portion and a lower narrower portion so that said rail by the closing of said lid may snap beneath said wider portion of said slotted member.

5. A box according to claim 1, characterized in that said box-shaped member two opposite sides each has an edge located adjacent to said open side and a portion of each of said edges projects beyond adjacent portions of its respective edge.

6. A box according to claim 1, characterized in that said inner member has a portion projecting from one of said opposite sides of said inner member, which portion defines the lid of the box by means of a folding line.

7. A box according to claim 6, characterized in that said inner member one opposite side has an upwardly directed part and a rail provided with a T-shaped groove has said upwardly directed part extending therein.

* * * * *